US007905641B2

(12) United States Patent
Peckham, Jr.

(10) Patent No.: US 7,905,641 B2
(45) Date of Patent: Mar. 15, 2011

(54) ROLLER SKATE WHEEL HUB CAP WITH INTEGRAL ILLUMINATION SYSTEM

(76) Inventor: Alfred H. Peckham, Jr., Ingalls, IN (US)

( * ) Notice: Subject to any disclaimer, the term of this patent is extended or adjusted under 35 U.S.C. 154(b) by 334 days.

(21) Appl. No.: 12/191,715

(22) Filed: Aug. 14, 2008

(65) Prior Publication Data

US 2010/0038869 A1 Feb. 18, 2010

(51) Int. Cl.
*B60Q 1/00* (2006.01)
*A63C 17/14* (2006.01)

(52) U.S. Cl. ..... 362/500; 280/11.203; 301/5.301

(58) Field of Classification Search ..... 362/500, 362/273; 280/11.203; 301/5.301
See application file for complete search history.

(56) References Cited

U.S. PATENT DOCUMENTS 5,475,572 A * 12/1995 Tseng ..... 362/545
5,957,541 A * 9/1999 Seigler ..... 301/5.301
7,387,303 B1 * 6/2008 Spillman et al. ..... 280/11.19

* cited by examiner

*Primary Examiner* — Jason Moon Han
*Assistant Examiner* — Sean P Gramling
(74) *Attorney, Agent, or Firm* — Bruce J. Bowman

(57) ABSTRACT

A hub cap for a roller skate wheel incorporates an LED illumination system. The illuminated hubcap is configured to slidably extend through apertures of a skate wheel and allow securement of the hub cap on the roller skate wheel. The hub cap may be formed of a rigid or semi-rigid material such as a plastic or the like. The LED illumination system includes a mount situated upon the planar surface of the hub cap so as to be essentially perpendicular with a skating surface when the hub cap is situated on the skate wheel. The hub cap body carries at least one LED so that light is emanated outward into the ambient area adjacent to the hub cap. Circuitry, including a battery and switch are carried on the inner surface of the hub cap body and controls the lighting of the LED (or LEDs). The LEDs may be white, a single color, multiple colors, or any combination thereof.

13 Claims, 5 Drawing Sheets

ROLLER SKATE WHEEL HUB CAP WITH INTEGRAL ILLUMINATION SYSTEM

BACKGROUND OF THE INVENTION

1. Field of the Invention

The present invention relates to illumination devices for roller skates and, more particularly, to a hub cap for a roller skate wheel that incorporates an integral illumination system.

2. Background Information

From roller skating to in-line skating to even ice skating, skating is a fun and healthful recreation and/or sport for many adults and children. Skating of all types is gaining in popularity especially because of the recognition of the healthful benefits such activity can bring. With popularity comes ingenuity. Some of such ingenuity has been directed towards providing illumination for skates.

Illumination can provide visual imagery for the skater and for people watching the skater. It can also provide aesthetic enhancement for the skater and/or skate. Moreover, illumination provides a safety factor when used at night. Because of this, various illumination systems have been developed for skates as well as other items such as skateboards, shoes, headbands and gloves.

With respect to in-line skates, there are a number of prior art devices that are designed to provide illumination such as U.S. Pat. No. 6,851,817 issued to Wong (hereinafter "Wong"). Wong provides a molded in-line skate that incorporates a flashing light feature having a power source, a plurality of lighting elements and a flashing circuit to selectively provide lighting signals to the plurality of lighting elements. The wheel also incorporates at least two motion switches to activate the flashing circuit when the wheel rotates. Because this is an entire molded closed wheel, there are numerous disadvantages such as, but not limited to, cost, complexity, ease of use, maintenance and the like.

U.S. Pat. No. 6,530,581 issued to Lai provides an illuminating wheel or roller for an in-line skate formed as a polymer jacket wrapped around the exterior of a hub formed by two hub covers. The hub is internal to the jacket and houses a circuit board, a plurality of illuminators, a battery compartment, and a vibration switch. Cushion is provided within the hub for protection of the components by absorption of vibration with the exception of the vibration switch. Illuminators are installed in the hub cover so that the light is visible on both sides of the wheel. The vibration switch actuates the illuminators when the wheel vibrates (e.g. moves). The hub defines a central axle bore through which an axle extends in order to mount the wheel to the skate or scooter. Again, since this is a molded closed wheel, there are many disadvantages.

U.S. Pat. No. 6,241,371 issued to Dai describes an activating device for a light-and-sound-emitting in-line skate wheel incorporating a plurality of light emitting elements, a power source and a sound and light generating circuit. A plurality of chambers are formed around the wheel hub that are defined by a plurality of radially arranged spokes. The sound and light generating circuit is disposed in one of the chambers while an illuminating element is disposed in each chamber. A centrifugal force switch is used to actuate the sound and light generating circuit as the skate wheel rotates. As an entire molded closed wheel, it too suffers from the same disadvantages as the others.

A further example of a lighting system for in-line skate wheels is U.S. Pat. No. 5,957,541 issued to Seigler (hereinafter "Seigler"). Seigler provides an illuminating ring device for a closed molded type in-line skate wheel incorporating a power source, a centrifugal switch and a light emitting diode. The illuminating ring device snap fits into an annular groove about the axle of the wheel.

U.S. Pat. No. 5,873,600 issued to Conway provides a modular light generating and emitting in-line wheel wherein the components are incorporated into the wheel. The wheel includes three pieces—an interchangeable tire, hub and stationary drum. The wheel includes at least one light source for illuminating the wheel. The removable inner hub accepts a generator and is used as a means of power for the light source.

U.S. Pat. No. 5,799,344 issued to Tseng provides a light emitting wheel for an in-line skate with the wheel having an annular groove about the center axle of the wheel in which an annular circuit board having illuminating components thereon is situated. The illuminating components include a plurality of illuminating elements, an automatic switch, two metal contact plates at opposite sides of an opening, and a battery connected between the metal contact plates to provide an electric power supply to the light emitting elements through the automatic switch.

A problem with these prior art illumination systems is that they are integral with the skate wheel. Therefore, since they are an integral part of the skate, they cannot be easily removed in order to transfer the system to another skate if desired. In the event the wheels containing the integral illumination system are removed from the host skate, said skate would become inoperable (without wheels). Moreover, this complicates the ability to repair the lighting system if something should go wrong.

Unlike the devices set forth above which relate to in-line skate wheels or closed molded wheels, there are illumination systems related to roller skate wheels. For example, U.S. Pat. No. 5,294,188 issued to Vancil, Jr. describes an illuminated roller skate wheel in which the wheel has a special conical cavity. An insert housing is provided and arranged for complementary reception in the conical cavity. The insert housing includes a battery, illuminating elements, circuitry, and electrical contacts that actuate the illuminating elements upon the application of centrifugal force such as during rotation of the wheel. Upon installation, this illuminated conical housing is secured to a roller skate wheel by receiving there through the axle of the roller skate.

U.S. Pat. No. 4,363,502 issued to Bakerman provides an illuminating roller skate wheel having a light emitting system disposed internally and integrally with the wheel. The light emitting system includes a battery, a switch and a plurality of light emitting elements. A centrifugal force switch or electrical generator may also be used. A hub cap formed of a translucent material is provided over the light emitting system of the wheel. Because this device relates to an integral roller skate wheel, it cannot be detached from the roller skate wheel without removing the roller skate wheel. In some instances it may be necessary to replace the entire integral roller skate wheel should this device need repair.

Of these devices for roller skate wheels, some are directed to externally attachable devices. For example, U.S. Pat. No. 5,278,733 issued to St. Thomas, there is provided a decorative lighting apparatus for connection to the outside of a roller skate wheel and axle supporting the wheel. The lighting apparatus includes a unitary housing that is positioned about the axle and brought into frictional engagement with the wheel. A battery operated light bulb is connected to the housing and battery, thereby rotating with the wheel. By extending substantially beyond the width of the roller skate wheel, this lighting apparatus is susceptible to being damaged while employed upon the roller skate wheel.

U.S. Pat. No. 3,789,208 issued to Lewis discloses a roller skate wheel illumination attachment that is provided that is removably attachable to the outside of a roller skate wheel. The illumination attachment includes a battery, illuminating element, and switch.

The problem with these skate illumination systems is that they are either attached to the skate wheel in an awkward manner or have components or elements that extend beyond the perimeters of the skate wheel. In both instances, such lighting systems may be easily damaged during normal use. Moreover, such lighting systems can easily become detached from the skate wheel.

It is therefore evident from the above that there is a need for a roller skate wheel lighting/illumination system that can be easily placed on and removed from a roller skate wheel and/or transferred to another roller skate wheel.

It is therefore also evident from the above that there is a need for a roller skate wheel lighting/illumination system that eliminates or reduces the chance of breakage during use.

SUMMARY OF THE INVENTION

The present invention is a hub cap for a roller skate wheel having an integral Light Emitting Diode (LED) illumination system. The hub cap incorporates a switch that is in electrical cooperation with a power source and one or more LEDs, and controls the on/off operation of the illumination system. The hub cap is configured to be demountably attached to a typical roller skate wheel by projecting leg members and conceals the hub of the roller skate wheel during use. The hub cap may be formed of a rigid or semi-rigid material such as plastic or the like.

In one form, the hub cap is defined as having inner and outer surfaces. Connected to the inner surface are leg members projecting outward in a generally perpendicular manner from the inner surface. The leg members are adapted to be engaged within and extend through existing apertures in the roller skate wheel hub for mounting the present illumination hub cap onto the roller skate wheel.

The components of the LED illumination system are preferably, but not necessarily, mounted on the inner surface of the hub cap. Portions of some components extend through and are usable and/or viewable from the outer surface thereof. In this regard, one or more LEDs are positioned relative to the outer surface to provide varying illumination patterns which are viewable therefrom. The LEDs can also be positioned about the inner surface without being viewable through the outer surface. In either event, the LEDs may be mounted about the inner or outer surfaces in any pattern or combination so long as the LEDs do not interfere with the other components of the illumination system.

The hub cap is typically installed upon a roller skate wheel that has previously been installed upon a roller skate. The hub cap is secured to the skate wheel by inserting the leg members through existing apertures in the skate wheel hub. Upon inserting and holding the hub cap in the mounted position in close proximal fitment to the skate wheel, a fastening member is inserted into each leg member within one of a plurality of apertures dispersed longitudinally along the distal ends of each leg member. The apertures are spaced in a manner to facilitate a snug fitment of the inner surface against the skate wheel when the fastening members are inserted into the appropriate apertures within the leg members. One or more LEDs are situated in a manner where its lighted portion extends through a respective aperture in the hub cap thereby allowing the illumination of the LEDs to be viewed from the outer surface.

The switch used to control the on/off operation of the LED illumination system is preferably, but not necessarily, mounted on the inner surface of the hub cap such that the lever portion of the switch extends through an aperture in the hub cap thereby allowing the end user to manipulate the switch from the outer surface of the hub cap. The inner surface also preferably, but not necessarily, carries a power supply such as a flat watch battery which energizes the LED(s) upon the switch being turned to the "on" position. There exists a compliment of wires necessary to form an electrical circuit between the battery, switch, power supply, and LED(s).

During operation, the LED directs emanating light outward in relation to the skate wheel. To remove the hub cap from the host skate wheel, the end user simply removes the fastening devices from the leg member apertures and slides the leg members of the hub cap outwardly through the apertures in the skate wheel hub.

The leg members may be constructed with threaded portions sized to slidably engage within the apertures in the skate wheel hub. Upon inserting and holding the hub cap in the mounted position in close proximal fitment to the skate wheel, a bushing or washer and a suitable threaded nut of any variety, such as a winged nut, is threadably engaged upon each leg member in a manner which facilitates a close proximate fitment between the skate wheel and the hub cap.

To remove the hub cap from the host skate, the end user simply removes the threaded nut and washer and/or bushing from each leg member and slides the hub cap outwardly through the apertures in the skate wheel hub.

The hub cap is recess fitted into the wheel hub cavity of the skate wheel in a manner wherein the outer surface (the portion of the skate wheel hub which is substantially covered by the installed hub cap) of the hub cap is in substantial planar alignment with the outer skate wheel surface which is perpendicular to the skating surface. Upon being secured to the skate wheel, only the shoulder portion of the hub cap is in physical contact with the outer surface of the skate wheel hub. There also exists at least one aperture in the shoulder portion or inner surface which provides a conduit for light to emit from the wheel hub cavity to the ambient area adjacent the outer surface of the skate wheel. The inner surface carries one or more LEDs.

A roller skate wheel LED illumination system includes a plurality of skate wheel hub caps for the plurality of roller skate wheels, each having an inner surface and an outer surface, where the LED's lighted portion is visible from the area in close proximity to the outer surface, with both inner and outer surfaces being substantially perpendicular with a skating surface when each hub cap is situated upon the skate. It is noted that each hub cap may carry more than one LED to enhance the lighting effect presented by the hub cap when in operation.

The more important features of the invention have been outlined rather broadly in order that the detailed description thereof that follows may be better understood, and in order that the present contribution to the art may be better appreciated. There are, of course additional features of the invention that will be described hereinafter and which may form the subject matter of claims appended hereto. Those skilled in the art will appreciate the concept upon which this disclosure is based, and may readily be utilized as a basis for designing other structures, methods and systems for carrying out the purposes of the present invention. It is important, therefore, that the claims be regarded as including such equivalent constructions insofar as they do not depart from the spirit and scope of the present invention.

These, together with objects of the invention, along with the various features of novelty which characterize the invention, are pointed out with particularity in the following description and claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Like reference numerals indicate the same or similar parts throughout the several figures.

DETAILED DESCRIPTION OF THE PREFERRED EMBODIMENTS

Figure 1:
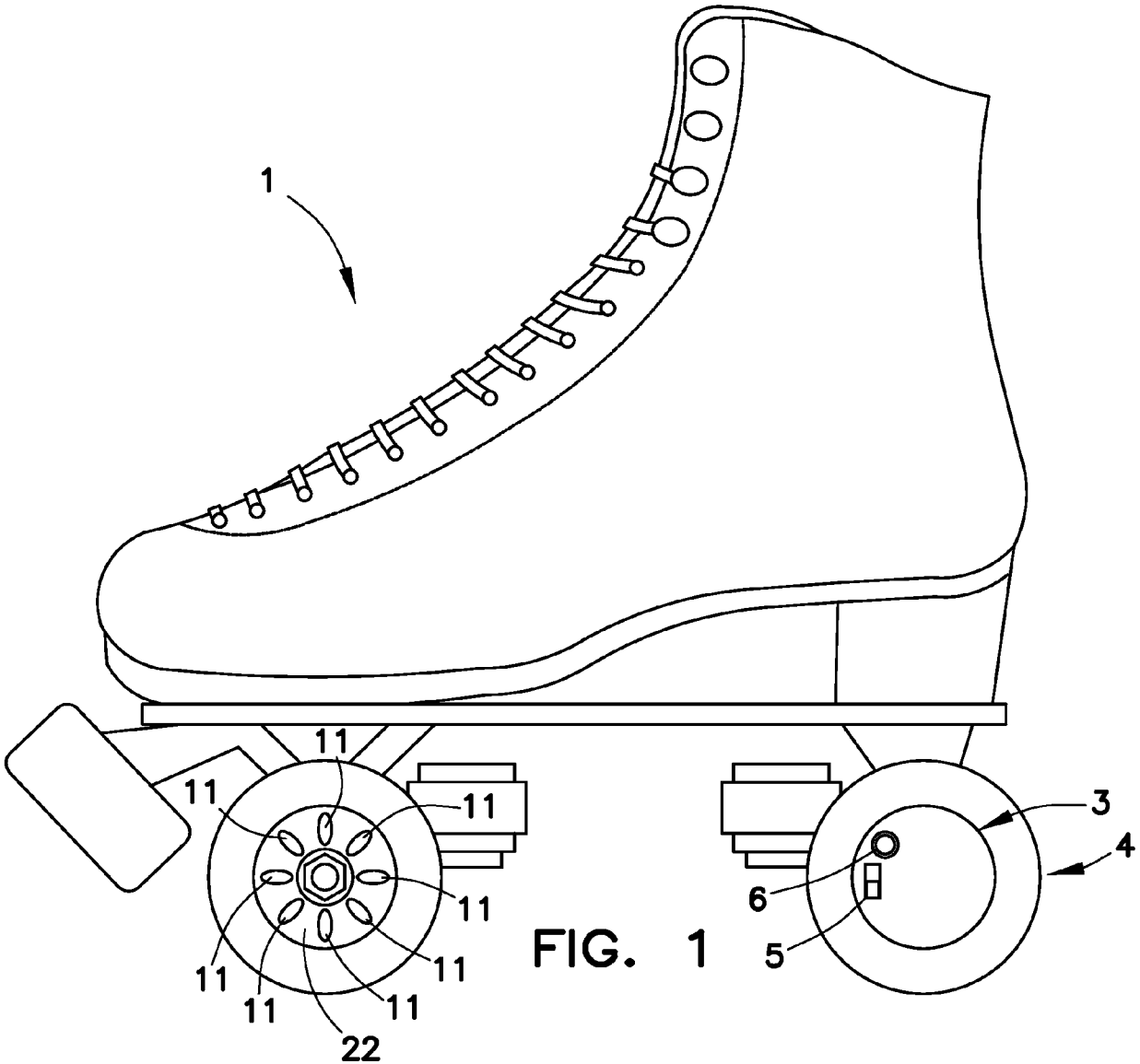
FIG. 1 is a side view of a typical roller skate having an exemplary embodiment of a roller skate wheel hub cap having an integral LED illumination system fashioned in accordance with the present principles disposed on a rear wheel, the front wheel of which does not have an exemplary embodiment of the present hub cap illumination system illustrating the difference in appearance between a roller skate wheel having the present hub cap installed, and one that does not.

The subject invention is related to the area of four wheeled roller skates, and more particularly to a roller skate wheel hub cap. Referring to FIG. 1, there is depicted a typical roller skate 1 in which two of the four wheels are shown. Each roller skate wheel typically incorporates a central hub aperture which accepts a cooperatively sized axle shaft projecting from the chassis/truck assembly of the roller skate. Roller skate wheels are also typically comprised of an outer wheel portion and an inner hub portion. The inner hub portion typically includes a plurality of apertures which serve to lighten the wheel as well as provide a more aesthetically pleasing roller skate wheel. These features are shown in regard to the front wheel 4 of skate 1. FIG. 1 shows the apertures 11 of the skate wheel 4 situated radially from a hub or hub area 22 through which an axle extends.

As shown in FIG. 1, an illuminated hub cap 3 fashioned in accordance with the principals of the present invention is installed upon one of the roller skate's rear wheels. The subject hub cap features an integral LED (Light Emitting Diode) illumination system.

The illuminating hub cap 3 is configured, adapted and/or operable to provide, in addition to other features, an aesthetically pleasing illumination emanating from one or more wheels 4 of a roller skate 1. Particularly, the roller skate hub cap 3 provides outwardly projecting illumination or light of one or more colors, of white light, or a combination thereof as desired. The hub cap 3 provides illumination by an LED 6. It is noted that other suitably sized illumination members may be substituted for the LED 6 as set forth throughout the various embodiments illustrated herein. It is also intended that the color of the LED(s) may be substituted for various colors or have other visual characteristics as the end-user finds visually appealing.

Figure 2:
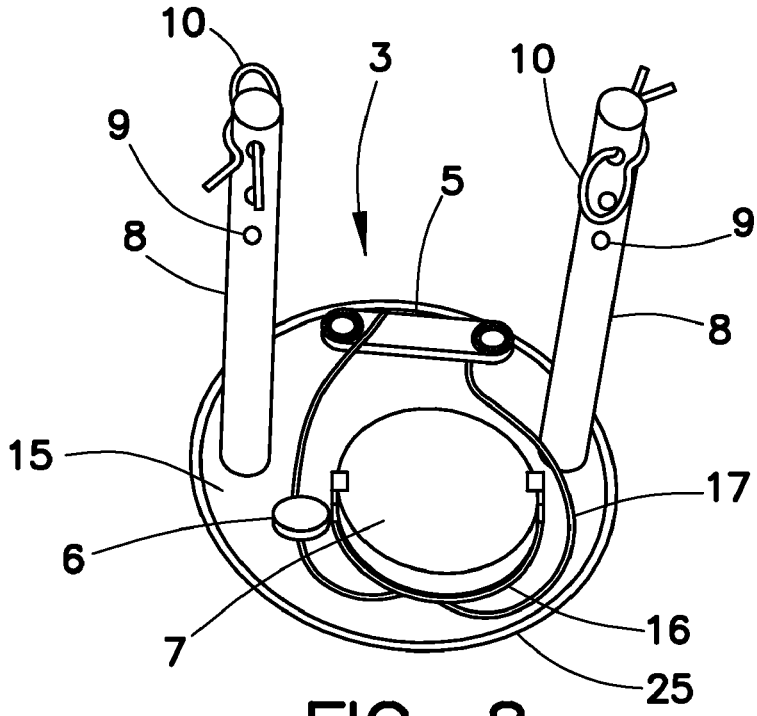
FIG. 2 is a perspective view of a rear of the roller skate wheel hub cap of FIG. 1 wherein the legs, the LED, the power supply, the wires, leg member apertures, and the switch are disposed on the inner surface of the skate wheel hub.
Figure 4:
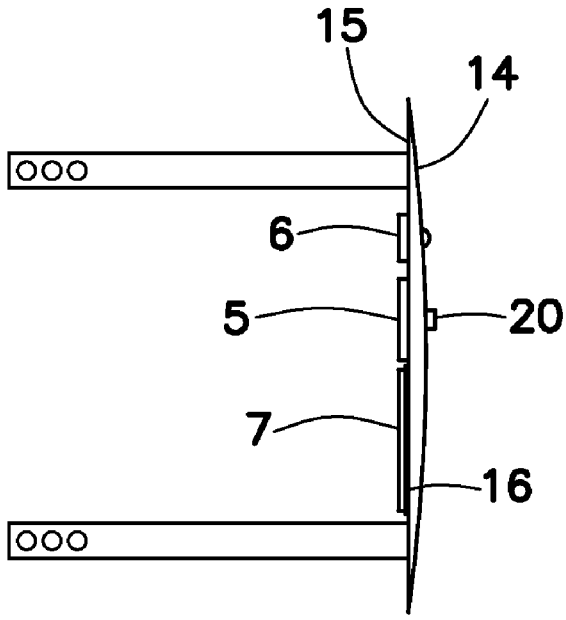
FIG. 4 is a side view of the hub cap of FIG. 2, particularly showing the perpendicular leg members, the LED, the battery, and the switch.

Referring to FIG. 2, the backside of the illuminating hub cap 3 is shown. The present illuminating hub cap 3 is defined by a body 25 formed as a disk having an inner surface 15 and an outer surface 14. As best seen in FIG. 4, the outer surface 14 is generally slightly curved, while the inner surface is generally planar. Of course different geometries may be used.

Figure 3:
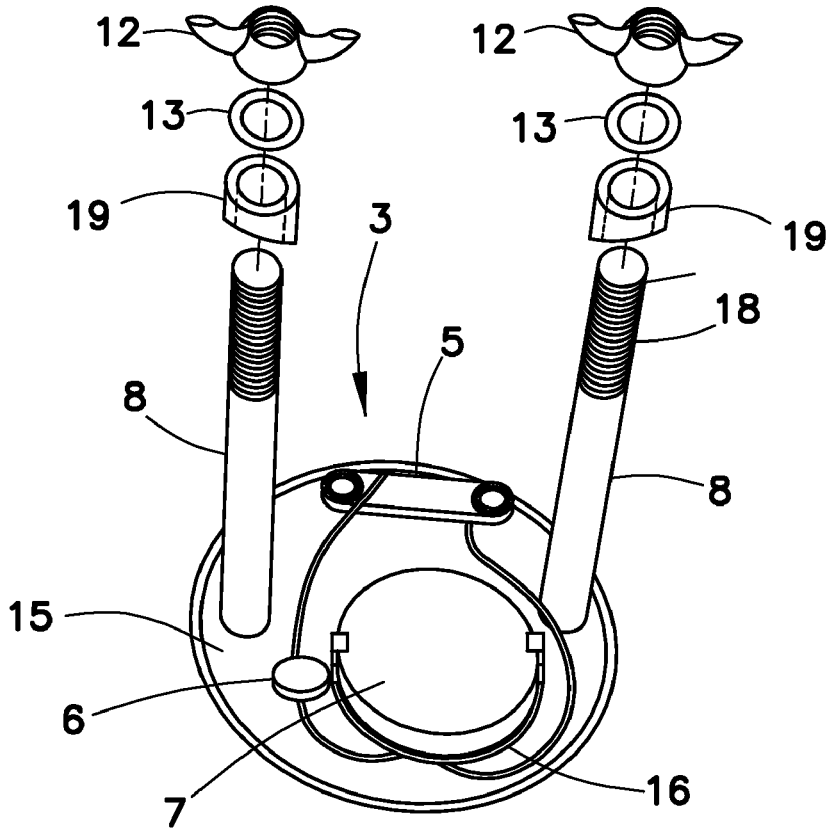
FIG. 3 is a rear perspective view of an alternate embodiment of the roller skate wheel hub cap of FIG. 1 wherein the member legs are threaded to receive a washer and/or bushing and nut for mounting the hub cap.

Still referring to FIG. 3, the inner surface 15 carries the battery clip in the same manner as the embodiment of FIG. 2, which retains the battery 7 used as a source of electricity to power the LED 6. The battery 7 as shown is a typical one and a half (1.5) volt watch battery. It should be appreciated that other types, styles and/or voltages of batteries and/or more than one battery may be used to power the LED. Also shown carried by the inner surface 15 is the switch 5, the battery 7, battery clip 16, LED 6, and wires 17 which comprise the electrical circuit between the battery 7, LED 6, and switch 5.

The present illuminating hub cap 3 further includes leg members 8 that, in this embodiment, are fabricated from a semi-rigid material such as plastic. It is also noted that the hub cap 3 and leg members 8 may also be fabricated from a rigid material such as aluminum or other metal alloy. The leg members 8 project outward in a substantially perpendicular fashion from the inner surface 15. The leg members 8 incorporate apertures 9 displaced in a longitudinal fashion thereupon. Each leg member is shown as having a fastening member 10 installed within selected apertures 9 of each leg member 8 for demonstrational purposes.

Referring to FIG. 3, an alternate embodiment is shown wherein each leg member 8 has a threaded portion 18 at its distal end sized to receive a cooperatively sized washer 13 and/or bushing and a threaded nut 12. In operation, the hub cap 3 is typically installed upon a roller skate wheel 4 that has previously been installed upon a roller skate. The hub cap 3 is secured to the skate wheel by inserting the leg members through existing apertures in the skate wheel hub 11. A suitably sized washer 13 and/or bushing 19 along with a suitable threaded nut 12 of any variety, such as a winged nut, may be threadably engaged upon each leg member 8 in a manner which facilitates a close proximate fitment between the hub cap 3 and the wheel 4. The bushing 19 may be constructed in a beveled fashion where one end follows the contour of the skate wheel hub, and the other end provides a flat surface in which to receive the washer 13 or nut 12. To remove the hub cap 3 from the host skate 1, the end user simply removes the nuts 12, washers 13 and/or bushings 19 (if installed) from the leg members and slides the leg members 8 outwardly through the apertures 11 in the skate wheel hub.

Figure 5:
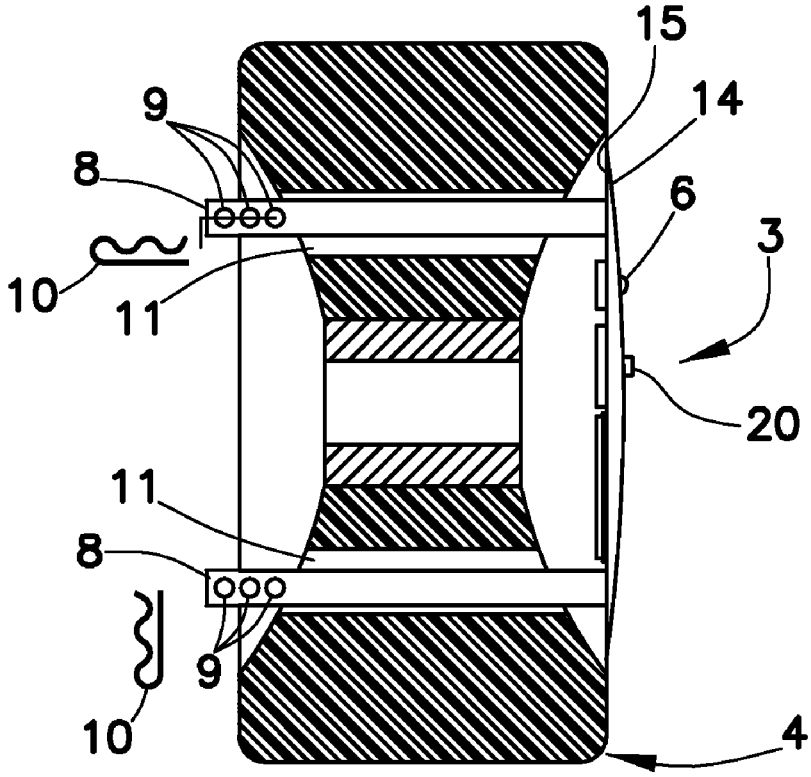
FIG. 5 is a side sectional view of the roller skate wheel of FIG. 1, wherein the hub cap of FIG. 2 has been slidably engaged into the installed position upon the roller skate wheel hub.

Referring to FIG. 5, there is illustrated the hub cap 3 of FIG. 2 in the installed position. In operation, the hub cap 3 is typically installed upon a roller skate wheel 4 that has previously been installed upon a roller skate. The hub cap 3 is secured to the skate wheel by inserting the leg members through existing apertures in the skate wheel hub 11. Upon inserting and holding the hub cap 3 in the mounted position in close proximal fitment to the skate wheel 4, a retaining member 10 is inserted into each leg member within one of a plurality of apertures 9 dispersed longitudinally along the distal ends of each leg member 8. The apertures 9 are spaced in a manner to facilitate a snug fitment of the inner surface 15 against the skate wheel 4 when the retaining members 10 are inserted into the appropriate apertures 9 within the leg members 8. To remove the hub cap 3 from the host skate 1, the end user simply removes the retaining members 10 from the leg member apertures 9 and slides the leg members 8 outwardly through the apertures in the skate wheel hub.

The inner surface 15 carries a LED 6 situated in a manner where its lighted portion extends through an aperture in the hub cap 3 thereby allowing the illumination of the LED 6 to be viewed from the outer surface 14 when the hub cap is installed upon the skate. The switch 5 used to control the on/off operation of the LED illumination system is mounted on the inner surface 15 wherein the lever 20 portion of the switch 5 extends through an aperture in the hub cap 3 thereby allowing the end user to manipulate the switch 5 from the outer surface of the hub cap. Once again, during operation the LED 6 directs emanating light outward in relation to the skate wheel 4.

Referring to FIG. 4, there is illustrated the hub cap 3 of FIGS. 2 and 5, in the uninstalled position. The relationship of the elements positioned upon the inner surface 15 and outer surfaces of the hub cap 3 are shown. The inner surface 15 shows the underside of the switch 5 in relationship to the lever 20 portion of the switch 5 which extends through an aperture in the hub cap 3. The illuminated front portion of the LED 6 is visible from the outer surface 14 while the back portion of the LED is visible through the inner surface 15. The inner surface carries the battery clip 16 and the battery 7.

Figure 8:
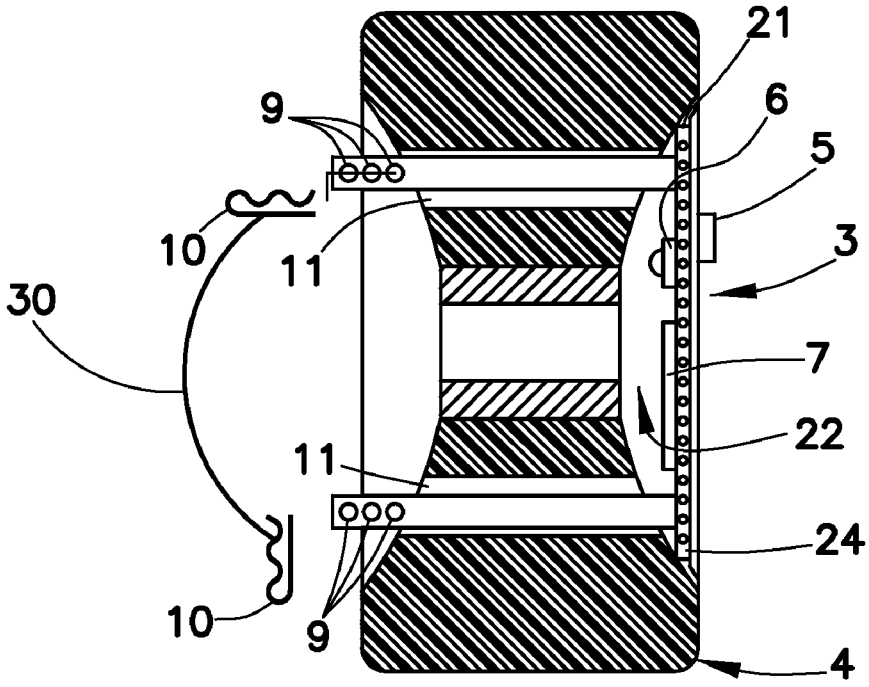
FIG. 8 is a side sectional view of a roller skate wheel wherein the hub cap of FIG. 9 has been slidably engaged into the installed position upon the skate wheel hub.

Referring to FIG. 8, there is illustrated an alternate embodiment of the hub cap 3 in the installed position. In this embodiment, the body 22 is further defined as having an outer surface 14 and an inner surface 15 which is further comprised of a shoulder or peripheral portion 21 that is radially positioned about the body 22. The inner surface 15 and the outer surface 14, along with the shoulder portion 21, are substantially perpendicular with a skating surface when the hub cap 3 is situated upon the skate. The hub cap 3 is formed to be recess fitted into a portion of the wheel hub cavity 22 in a manner wherein the outer surface 14 of the hub cap 3 is in substantial planar alignment with the outer skate wheel surface which is perpendicular to the skating surface. The shoulder 21 may include one or more apertures 24, such as are shown in FIG. 8, in the shoulder portion 21 or inner surface 15 which provides a conduit for light to emit from the inner surface 15 to the ambient area adjacent to the skate wheel 4. In this manner, the light source creates a halo effect about the edges or periphery of the hub cap. While not shown, the hub cap may extend slightly axially outward from the skate wheel to create a more pronounced halo effect.

Additionally, in FIG. 8 the attachment pins 10 are shown as connected by a wire 30 or the like. This allows easy removal of the pins 10 by grasping and pulling on the wire 30 when it is desired to remove the hub cap 3. Such connection also helps to keep track of the pins 10 so as not to lose them.

Figure 7:
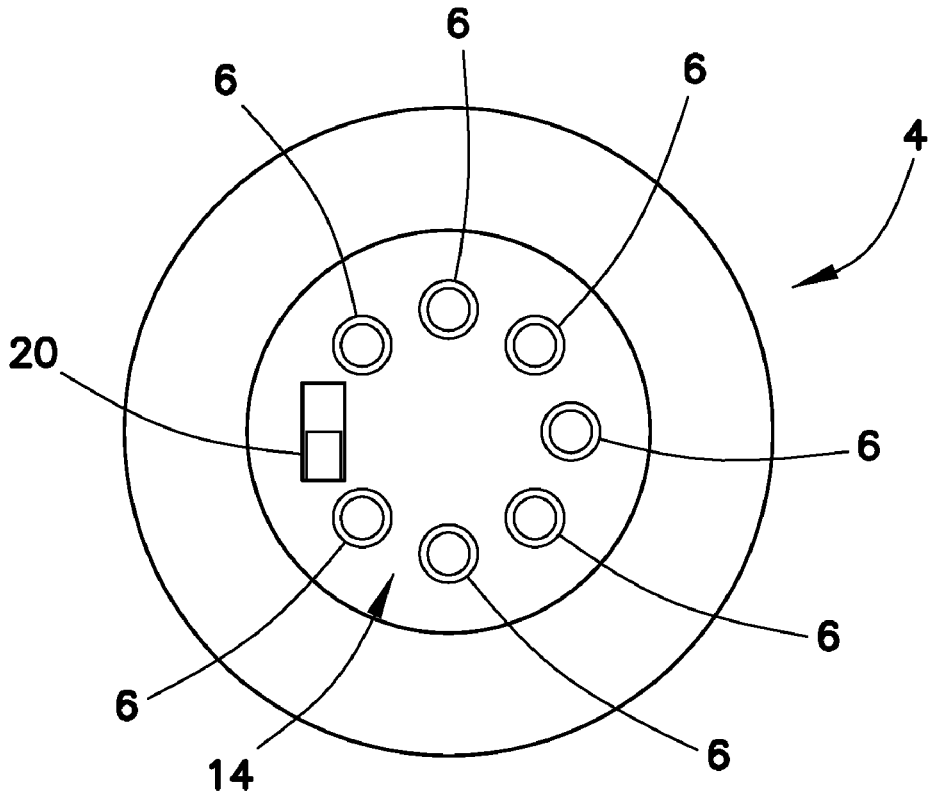
FIG. 7 is a front view of a roller skate wheel having an embodiment of the present illuminated roller skate wheel hub cap that incorporates a plurality of LEDs.

FIG. 7 shows a further alternative embodiment of the present invention wherein several LEDs 6 are carried by the inner surface 15 in a manner as to not interfere with the lever 20 portion of the switch. Once again, the LEDS 6 may emit white light, a single color of light, or any combination of white and/or colored light. The LEDs 6 may also be multicolored LEDs such as are known in the art. In this embodiment, the illumination systems circuitry of the hub cap 3 is wired to provide various visual effects of the LEDs such as blinking, racetrack, dimming, etc. The plurality of LEDs may be a single color or multiple colors.

Figure 6:
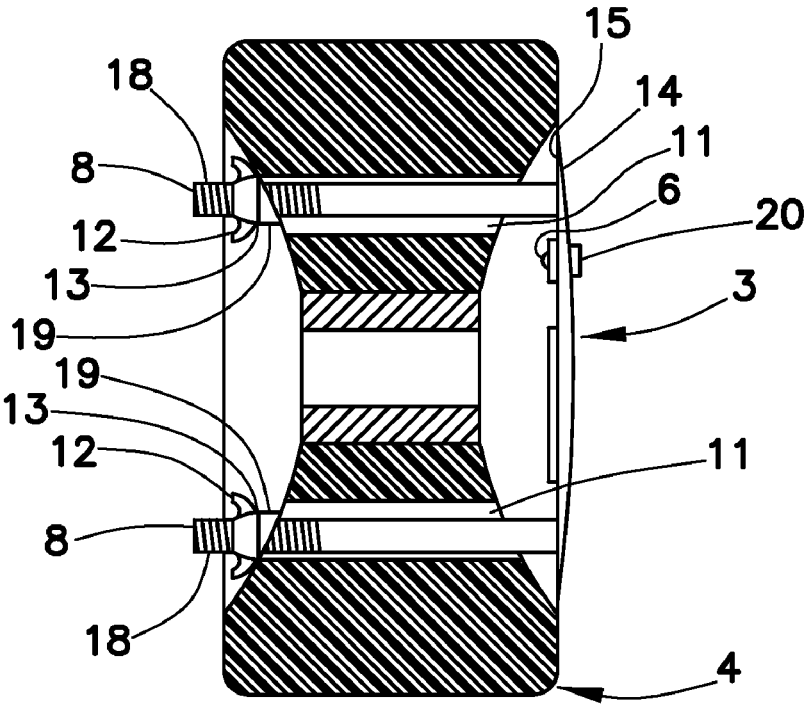
FIG. 6 is a side sectional view of a roller skate wheel wherein the hub cap of FIG. 3 has been slidably engaged into the installed position upon the skate wheel hub.
Figure 9:
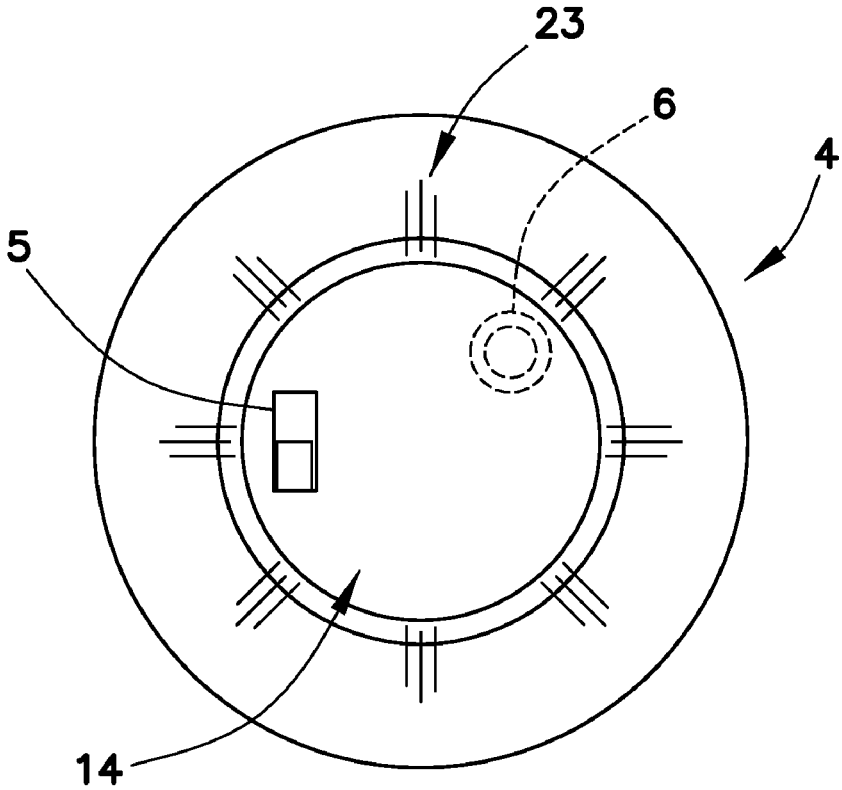
FIG. 9 is a front view of an alternate embodiment of the present invention, wherein the LED illumination system is displaced upon the inner surface of the hub cap, illustrating the manner in which the LED illumination system radiates light to the ambient area adjacent to the outer surface of the hub cap.

FIG. 9 illustrates the skate wheel 4 of FIG. 6, wherein the switch 5 has been switched to the "on" position thereby energizing the circuit. The illumination 23 of the LED 6 is radiated outward through the one or more apertures 24 (See FIG. 6) in the shoulder portion 21 or inner surface 15.

It should be appreciated that the present invention may include other modifications such as the number of legs or attachment members. Additionally, the legs may be fashioned differently than what is shown. For example, two or more legs may be formed as resilient wires or the like that include a 90° bend on their ends. This allows the legs to extend through the skate wheel and then to snap fit in place at the rear of the skate wheel, the 90° bend portion hooking onto the skate wheel. Other modifications are envisioned.

Moreover, other attachment members may be fashioned in order to have the present illuminated roller skate wheel hubcap fit other types of roller skate wheels such as open faced performance roller skate wheels. Spring loaded radial members may be used as attachment members that radially expand and contract to fit against and be removed from an inner rim of the roller skate wheel.

Additionally, other types of fastening devices may be used instead of pins as shown for fixing the leg-like attachment members relative to the roller skate wheel (and thus the hub cap to the roller skate wheel) as shown. For instance, rather than cotter pins, a spring wire having angled ends may be used to secure the legs on the back side of the roller skate wheel. Two configured spring wires may be used for a four leg embodiment of the present illuminated hub cap.

While the invention has been illustrated and described in detail in the drawings and foregoing description, the same is to be considered as illustrative and not restrictive in character, it being understood that preferred embodiments have been shown and described and that all changes and modifications that come within the spirit of the invention are desired to be protected.

What is claimed is:

1. An illumination system for a roller skate wheel comprising:

a hub cap carrying a light source, a switch, and a power supply all of which are adapted to provide illumination external to the hub cap; and attachment members adapted to secure the hub cap to a roller skate wheel through roller skate wheel apertures disposed radially adjacent a hub of the roller skate wheel located in the center of the roller skate wheel and to position the hub cap axially over the roller skate wheel hub, the attachment members comprising two outwardly projecting arms perpendicular to the hub cap, each arm having a plurality of member apertures spaced in a longitudinal manner along each arm that serve to secure the illumination system upon roller skate wheels of varying thicknesses, each member aperture being sized to receive a securing means.

2. The illumination system of claim 1, wherein the light source is positioned upon the hub cap in a manner where light emitted from the light source is dispersed into the ambient air adjacent the hub cap.

3. The illumination system of claim 2, wherein the light source comprises a plurality of light sources.

4. The illumination system of claim 3, wherein the plurality of light sources are all one color.

5. The illumination system of claim 3, wherein the plurality of light sources are multiple colors.

6. The illumination system of claim 1, wherein the light source is a light emitting diode.

7. The illumination system of claim 1, wherein the hub cap is formed of a rigid material.

8. The illumination system of claim 1, wherein an actuator of the switch projects through an aperture of the hub cap in a manner which makes manipulation of the actuator possible while the hub cap is installed upon a roller skate wheel.

9. A hub cap for a roller skate wheel, the hub cap comprising:

a hub cap body carrying a light source, a switch with an actuator, and a power supply all of which are adapted to provide illumination external to the hub cap; and attachment members adapted to secure the hub cap to a roller skate wheel through roller skate wheel apertures disposed radially adjacent a hub of the roller skate wheel located in the center of the roller skate wheel and to position the hub cap axially over the roller skate wheel hub, the attachment members comprising two outwardly projecting arms perpendicular to the hub cap body, each arm having a plurality of member apertures spaced in a longitudinal manner along each arm that serve to secure the hub cap upon roller skate wheels of varying thicknesses, each member aperture being sized to receive a securing means.

10. The hub cap of claim 9, wherein the body comprises an inner surface and an outer surface, the inner surface carrying the power source, the light source, the switch, and the attachment members;

the outer surface adapted to make manipulation of the actuator possible while the hub cap is installed upon a roller skate wheel, the outer surface further adapted to provide illumination external to the hub cap.

11. The hub cap of claim 10, wherein the light source comprises a plurality of light sources.

12. The hub cap of claim 9, wherein the light source is a light emitting diode.

13. The hub cap of claim 9, wherein the hub cap is formed of a rigid material.

* * * * *